United States Patent [19]

Yui

[11] Patent Number: 4,550,454

[45] Date of Patent: Nov. 5, 1985

[54] TOILET-BOWL BIDET APPARATUS

[76] Inventor: George M. Yui, 1543 Knareswood Dr., Mississauga, Ontario, Canada, L5H 2L9

[21] Appl. No.: 661,976

[22] Filed: Oct. 18, 1984

[30] Foreign Application Priority Data

Oct. 18, 1983 [CA] Canada ..... 439212

[51] Int. Cl.[4] ..... A47K 4/00; A47K 3/20; E03D 9/08

[52] U.S. Cl. ..... 4/420.4; 4/420.1; 4/420.3; 4/447; 4/448; 239/461; 239/524; 239/569; 239/590.5

[58] Field of Search ..... 4/420.1–420.5, 4/443–448, 601, 237; 239/461, 524, 569, 590.5

[56] References Cited

U.S. PATENT DOCUMENTS

| | | | |
|---|---|---|---|
| 1,571,616 | 2/1926 | Backherms | 239/524 |
| 2,105,154 | 1/1938 | Maxon | 239/461 |
| 2,408,588 | 10/1946 | Watts | 239/461 |
| 2,832,643 | 4/1958 | Bletcher et al. | 239/461 |
| 2,914,257 | 11/1959 | Wiant | 239/461 |
| 3,015,826 | 1/1962 | Aranas | 4/420.4 |
| 3,072,925 | 1/1963 | Nyman | 4/237 |
| 3,249,309 | 5/1966 | Blackhall | 239/524 |
| 3,577,567 | 5/1971 | Wintercorn | 4/420.1 |

FOREIGN PATENT DOCUMENTS

| | | | |
|---|---|---|---|
| 0059888 | 2/1982 | European Pat. Off. . | |
| 333962 | 12/1903 | France | 239/569 |
| 360378 | 6/1906 | France | 239/569 X |
| 108976 | 7/1917 | United Kingdom | 239/461 |

*Primary Examiner*—Stephen Marcus
*Assistant Examiner*—Linda J. Sholl
*Attorney, Agent, or Firm*—Donald E. Hewson

[57] ABSTRACT

An add-on bidet includes a moulded plastic seat (12) which has a channel-shaped cross-section. A pivoting spray-arm (108) is stowed between the toilet-bowl rim and the inside of the channel. The inner wall (16) of the seat acts as a splash guard. The spray-arm is mounted in bearings (214,102) which are formed in the walls (16,18) of the seat. The seat is able to pivot, for raising, on a pair of stubby pivot pins (36,38) widely spaced apart. One (38) is hollow, to convey water to the seat. There are no exposed hose pipes or other obtrusive components. The water control knobs (70,71,76) are accessibly located. Water leaves the spray-head (116) as a coherent tube of water, which gives rise to a soft, gentle stream, whether the flow volume is large or small. This is achieved by deflecting jets of water from nozzles so that the jets coalesce back into a stream.

14 Claims, 11 Drawing Figures

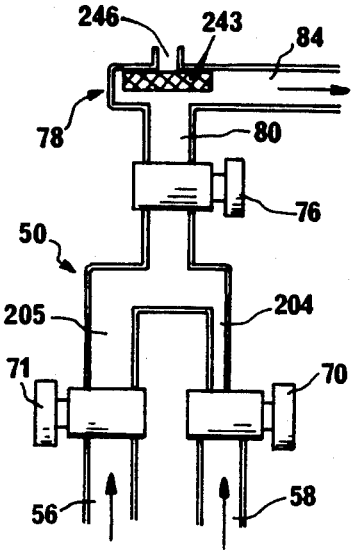
FIG7
FIG8
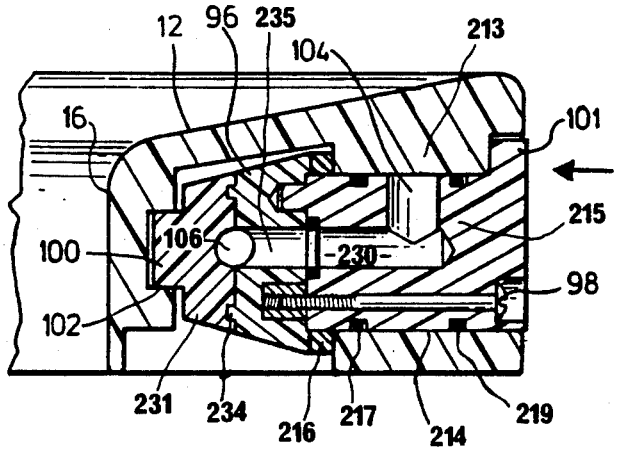
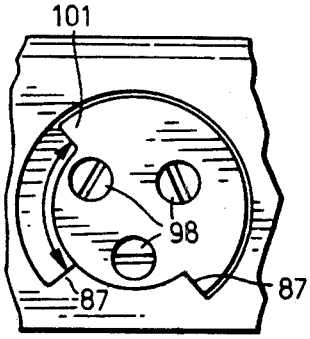
FIG.9

TOILET-BOWL BIDET APPARATUS

This invention relates to a bidet apparatus of the kind that fits as an add-on unit onto an existing toilet bowl.

BACKGROUND OF THE INVENTION

It is recognized that add-on bidets should be designed with the following points in mind:

1. The connection of the water supply to an add-on bidet inevitably involves skilled installation work by a competent plumber, but nevertheless the rest of the work of installation of the bidet should be such as to require a minimum of skill and special tools.

2. The designer should see to it that the manual water controls for the bidet are convenient to use, and progressive and controllable in their effect.

3. The bidet should include a movable spray-arm that can adjust from a not-in-use position to an in-use position. In the not-in-use position, the arm should be unobtrusive, or even invisible. The spray-arm must not obtrude into the entry area of the toilet-bowl when the spray-arm is not in use.

4. The water supply to the spray-arm should pass through the spray-arm pivot, so that there is no need for exposed hose-pipes.

5. The bidet includes a seat which can be raised and lowered, and preferably the spray-arm is pivoted onto this seat, rather than for example, onto a housing that remains fixed to the toilet bowl. There is more room on the seat than on the fixed housing to stow the spray-arm when the spray-arm is not in use. Also, again to avoid the use of exposed hose-pipes, the water-supply should pass through the hinge-pivot on which the seat is mounted.

PRIOR ART

Previous bidets designed to some extent according to the above premises can be seen in U.S. Pat. No. 1,346,252 (RATHBONE, July 13, 1920); U.S. Pat. No. 2,774,078 (PAZOS, Dec. 18, 1956); and U.S. Pat. No. 3,781,919 (AYALA, Jan. 1, 1974). In all these, the water supply passes through both the pivots, i.e. the pivot between the seat and the spray-arm, and the pivot between the seat and the toilet-bowl.

There are a number of other patents which are less relevant in that they do not show water passing through pivot-pins, but they show the use of flexible hoses to allow water to be fed to components that move. These are U.S. Pat. No. 1,949,415 (GUIDETTI, Mar. 6, 1934; U.S. Pat. No. 4,041,553 (SUSSMAN, Aug. 16, 1977; U.S. Pat. No. 4,069,519 (ALEXANDER, Jan. 24, 1978); and U.S. Pat. No. 4,406,025 (HUCK, Sept. 27, 1983).

BRIEF DESCRIPTION OF THE INVENTION

The first aspect of the invention lies in manufacturing the seat of the bidet as a plastic moulding. A feature of the invention is that the seat is moulded with a channel-shaped cross-section. This feature has these benefits:

(a) The seat can be moulded substantially as a constant-thickness item, which makes mass production of the seat a simple operation.

(b) The seat is light, yet is strong and rigid.

(c) The seat can be contoured with compound curvature when it is moulded. Such a moulded seat can be extremely rigid even though the material is quite thin, and the seat can be of pleasing yet functional shape and appearance.

(d) The seat can be provided with bumpers, so that when the seat is down, there is a space between the channel shape of the seat and the rim of the toilet-bowl. This space can be used for the purpose of stowing or storing the spray-arm in its not-in-use position. The spray-arm is virtually completely hidden when not in use. However, the spray-arm can be quickly brought into its in-use position once the seat is raised.

Features that follow from the channel-shaped seat are:

(i) The inner side-wall of the seat can act as a water splash-guard, especially if the inner side-wall extends all around the seat. Such a splash-guard prevents water passing through the gap between the seat and the toilet-bowl, so that the person using the bidet can be much more confident in that use if he or she knows that no splashing of the water can result. This feature is absent from the prior art.

(ii) The moulded channel-shaped seat may be depressed at the front of the seat. This allows an access space for the hand of a person to be inserted. Preferably, the splash-guard continues all around the seat, including behind such a depressed region.

Other features of this aspect of the invention will become apparent from the description of a preferred embodiment of the invention, hereafter.

A second aspect of the invention lies in the manner of arranging the hinge-pivot upon which the seat is mounted for raising and lowering.

In the bidet-apparatus of RATHBONE, for example, a long hollow pin is provided. In the present invention, the effect of a long pin is gained, but without the expected expense and difficulty. The invention provides two short stubby pivot-pins, each on the same axis. These pins are well spaced apart to give a wide bearing spread for good stability.

One of the pins is hollow, and the water supply is conveyed through that pin.

One of the pins is movable in the axial direction. This allows the seat to be conveniently assembled to the non-pivoting, fixed, housing of the bidet. Assembly is done simply by manipulating the pins into suitable sockets. Thus, not only may the seat itself be a one-piece moulding, but the housing may be a respective one-piece moulding too. The pins may be mounted in the seat and may engage sockets in the housing, or vice versa.

Following on from this aspect of the invention are further features:

(i) The fixed housing or mounting-means may be formed with relatively wide pivot-pin housings respectively at the ends of a relatively slim bridge-piece. This a very convenient shape from the point of view of providing a good stable location of the seat in an economical manner. Furthermore, the wide pivot-pin housings serve admirably to receive the knobs of the water control valves.

(ii) If the seat is moulded with a channel-shaped cross-section, the sockets for receiving the pivot-pins can be conveniently provided simply by moulding the sockets into the other side wall of the channel.

Other features of this aspect of the invention will become apparent from the description of a preferred embodiment of the invention, herefter.

A third aspect of the invention lies in the manner of controlling the spray or jet of water in such a way as to render the spray or jet most suitable for use in a bidet.

In the invention, the flow of water is first broken up into several small jets. A deflector is placed in the path of the jets. The water in the jet impinges against the deflector, and the water is then caused to coalesce back into a stream, (i.e., a stream as distinct from several small jets).

Such an arrangement has these benefits:

(a) The water flow can be easily controlled, yet the control is positive, quick-acting, and stable.

(b) An ordinary spray-head produces jets that would impinge directly onto the body of the person using the bidet. Inevitably, the spray-head has to be some distance below the person's body, to allow room for his or her hands to contribute to the washing operation. Thus, if a simple spray-head were to be used, with its direct jets as described, the force of the jets would have to be quite strong. Many people find strong jets uncomfortable. They would prefer a high-volume flow at a low velocity, rather than a low-volume flow at a high velocity, which is what a conventional spray-head gives.

(c) Another benefit over the conventional several-small-direct-jets type of spray-head is this. It is very common for jet-holes to become partially clogged with scale, but not all the holes become clogged at the same rate. Some holes remain almost at their original size; others become restricted. The effect is that in order to keep up a high-volume flow, the water has to be forced out of those holes that are still free at a higher pressure. The result is even more discomfort for the user. Furthermore, such high-pressure jets cause the water to be splashed. However, when the jets are made to coalesce back into a stream, as in the present invention, such an effect gives no problems.

(d) The spray apparatus of the invention provides a large volume of water, which can easily be adjusted to the requirements of any person, man or woman, child or adult, vigorous person or invalid, without any of the discomfort or splashing associated with direct jets. Instead, the water is delivered in a soft, gentle, flow or stream.

Other features that follow this aspect of the invention may be summarized as:

(i) As will be seen from a perusal of the description which follows, the spray-apparatus of the invention can be arranged so that the water emerges as an annular tube. This tube of water has a very coherent formation, and the water stream has very little tendency to break up, even when the volume of flow is turned down as low as a person might wish. Whether such a flow of water is large or small, a person can still characterize it as soft and gentle. The fact that the water emerges as a tube provides also another benefit. With a conventional spray-head, the height to which the water rises after emerging from the spray-head varies with the through-flow. When the stream is a tube, the height of the water still does vary with the through-flow, but not to the same degree as the variation that results from a conventional spray-head. With the tube, the water tends to fan out, in that the water emerges as a diverging cone at large through-flows. The water emerges as a converging cone at low through-flows. The height reached by the water is substantially the same, which clearly is a desirable feature in a bidet. The reason why the tube of water is able to converge may be the presence of the space inside the tube. The moving water creates a partial vacuum in that space, which sucks the water inwards. When the flow-rate increases, the momentum of the water starts to overcome the suction effect.

(ii) Preferably, the bidet apparatus to which the spray is fitted has two such spray-heads. Preferably, each spray-head is individually adjustable as to the respective volumes of flow; from full-flow to substantially (but not quite) zero flow, each independently of the other. This controllability increases the convenience of the bidet to the user.

(iii) Preferably, the water supply to the spray-heads is provided with manual controls arranged in this manner: first, both hot and cold water supplies are independently adjustable, by respective separate knobs, as to their relative volumes of flow for temperature control; second, the combined flow is adjustable by means of a further knob. The fact that the spray-heads are themselves also adjustable as to volume renders the whole system very controllable as to both flow quantity and temperature. A bidet often is used while the toilet cistern is being re-filled. When the cistern is full, there can be a sudden change in the relative pressure differential between the hot water supply and the cold water supply. It is important that the controls should be quick-acting and effective to minimize the user's discomfort if this happens, which they are if the controls are arranged as above.

(iv) Preferably, the seat of the bidet is provided with a splash guard, so that the person who uses the bidet can have confidence that no splashing will result (even though splashing is less likely with the gentle flow of water, as described), no matter how vigorously the person washes.

Other features of this aspect of the invention will become apparent from the following description of a preferred embodiment of the invention.

DETAILED DESCRIPTION OF A PREFERRED EMBODIMENT

FIG. 7 is a diagram of the water controls;

FIG. 8 is a cross-sectional view on the line 8—8 in FIG. 3;

FIG. 9 is an elevation in the direction of the arrow in FIG. 8;

Figure 1:
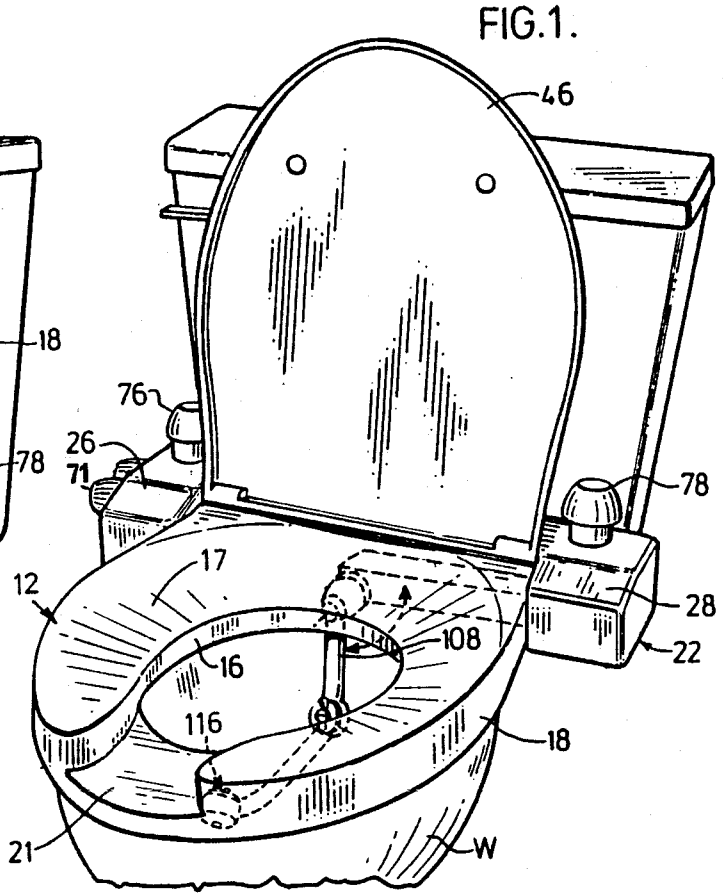
FIG. 1 is a pictorial view of the bidet of the invention fitted to a toilet.
Figure 2:
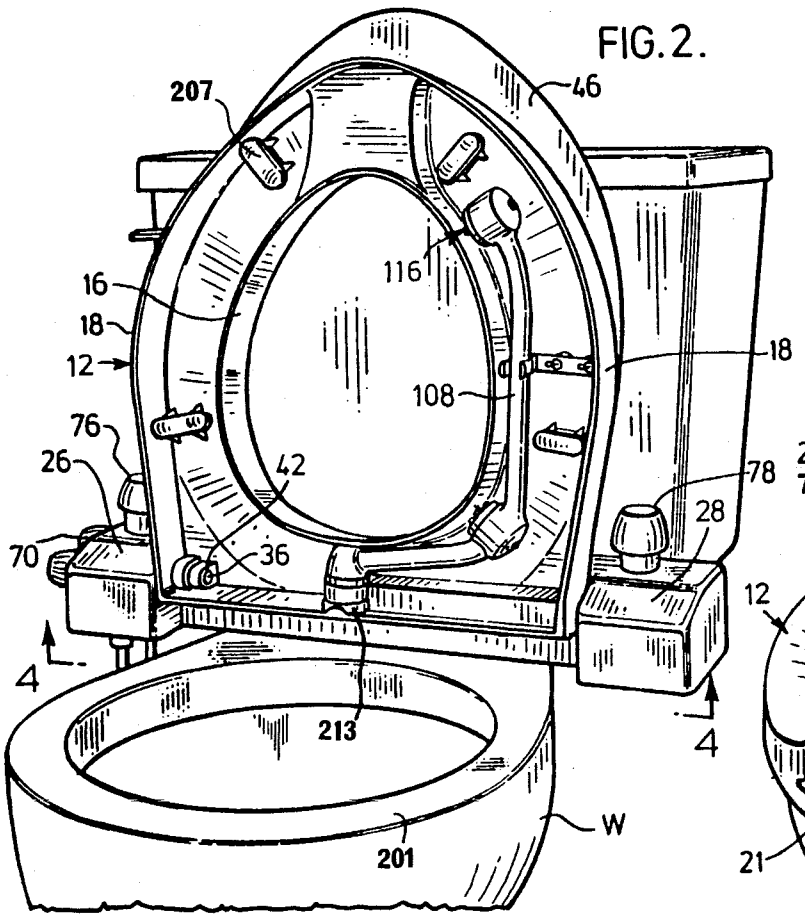
FIG. 2 shows the bidet of FIG. 1, with the seat raised.

The apparatus shown in the drawings will now be described in detail.

Mounting-means

A conventional toilet bowl W is provided with two holes which are located towards the back of the rim 201 of the bowl W. Normally, the conventional seat and lid assembly are attached by bolts which pass through these holes (not shown). To install the bidet assembly, the conventional seat, lid, and bolts are discarded, and the bolts 32 of the bidet are attached through the holes in the toilet bowl W.

The bolts 32 are fitted to mounting plates 202 which in turn are screwed to a plastic moulding 22. The extent to which the bolts are adjustable as regards their position in the moulding 22 can be seen in the drawings.

Figure 3:
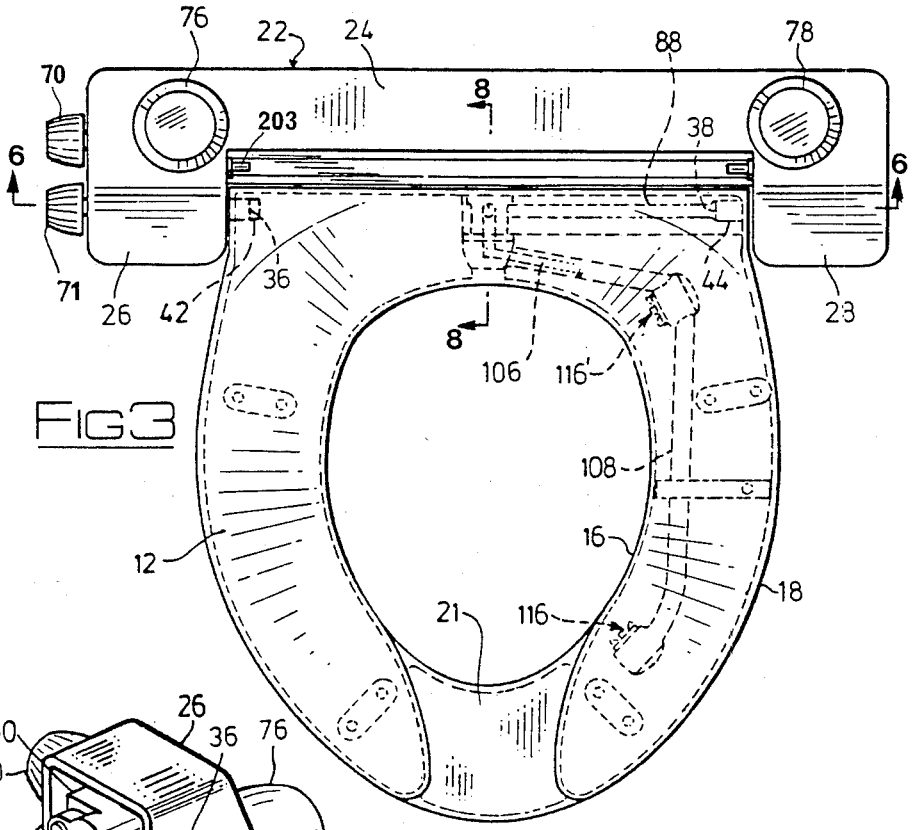
FIG. 3 is a plan of the bidet with the lid removed.

The seat 12, and lid 46, of the bidet are pivoted to the plastic moulding 22, so that either may be raised and lowered. The lid pivots about pivot-pins 203, while the seat pivots about pivot-pins 36,38 (FIG. 3). The seat 12 includes bumpers 207 upon which the seat rests on the rim 201 of the toilet bowl W.

The plastic moulding 22 includes a slim bridge-piece 24, which links two pivot-pin housings 26,28. The housings 26,28 protrude further forward than the bridge piece 24, and the seat 12 nestles between the housings.

Water controls

Figure 4:
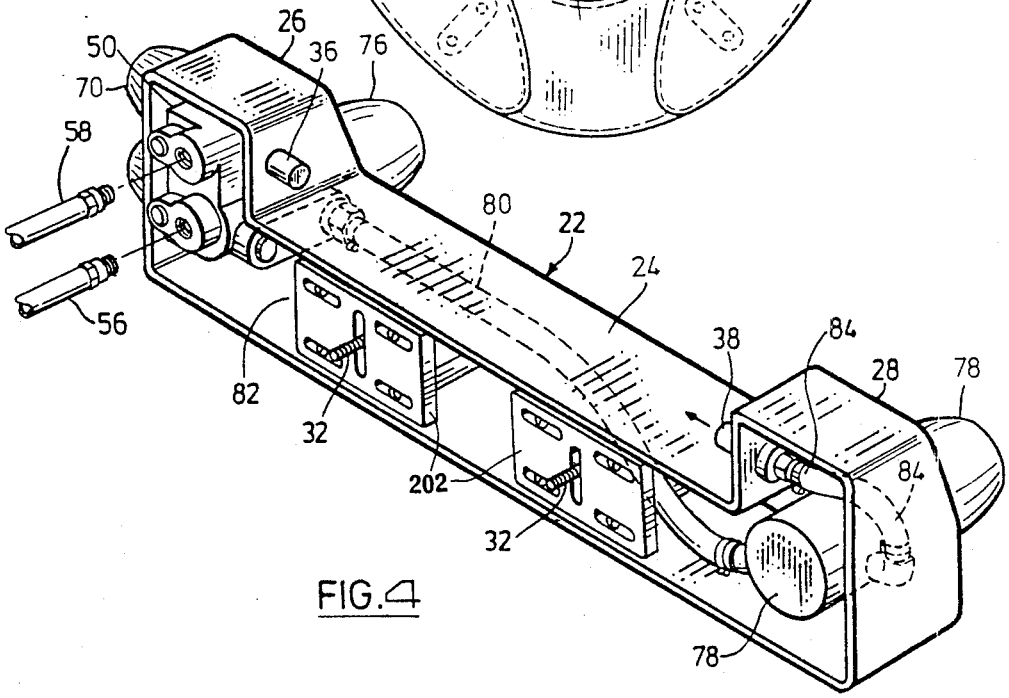
FIG. 4 is a pictorial view from underneath the mounting means of the bidet.
Figure 5:
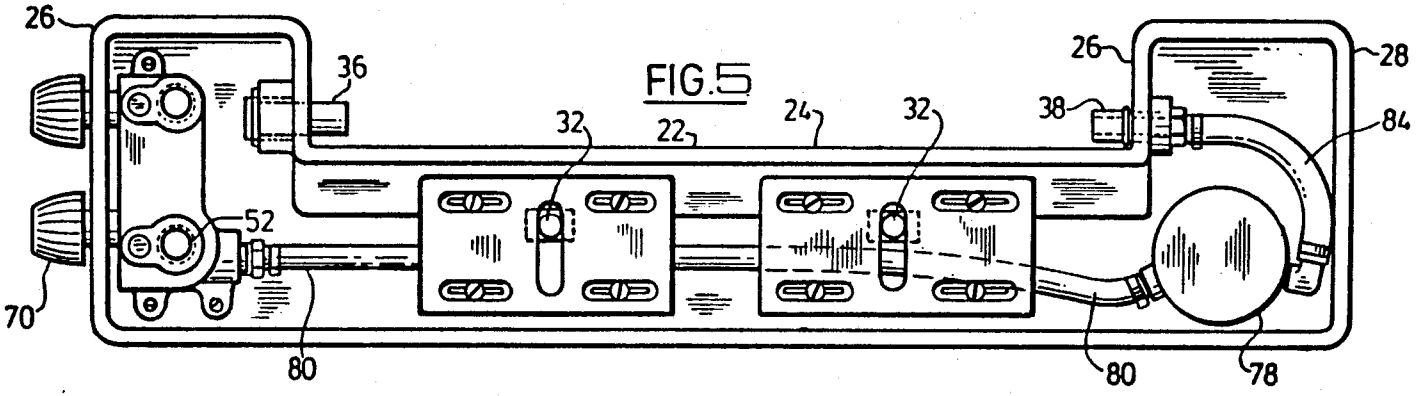
FIG. 5 is a bottom elevation of the view of FIG. 4.

As may be seen in FIG. 4, hot 56 and cold 58 water supplies are fed to a mixer valve 50. Individual control knobs, 70,71 are provided for adjusting the volume of each flow independently. A third knob 76 is provided to control the volume of the combined flow, after the hot and cold water have been mixed.

The porting and layout of the internal passages of the mixer valve 50 are shown diagrammatically in FIG. 7. A feature of the arrangement is that the passage 204 through which the cold water passes has a smaller cross-sectional area than the passage 205 through which the hot water passes. It is a fact that hot water is normally supplied at a lower pressure than cold water. Hence, the cold water flow has to be restricted more than the hot water flow to provide a comfortable temperature, and the passages, 204,205 provide this variation in restriction: and the variation is provided without affecting the ability of the knobs 71,70 to control the water temperature.

The combined flow of water from the mixer valve 50 is fed along the bridge-piece 24, through a pipe 80, to a vacuum breaker 78.

Vacuum Breaker

The vacuum breaker 78 is shown diagrammatically also in FIG. 7. It includes a movable stopper 243. When there is water pressure in the pipe 80, the stopper 243 is caused to settle in the position shown, where it seals off the vent 246. Water then flows into the pipe 84.

If there were no pressure in the pipe 80, on the other hand, then the stopper 243 would seal off the pipe 80. At the same time, the pipe 84 would be connected to the vent 246. Thus, water cannot be accidentally siphoned from the pipe 84 to the pipe 80.

From the vacuum breaker 78, the water passes into a flexible hose 84, which connects with the pivot-pin 38.

Hinge-pivot means

Figure 6:
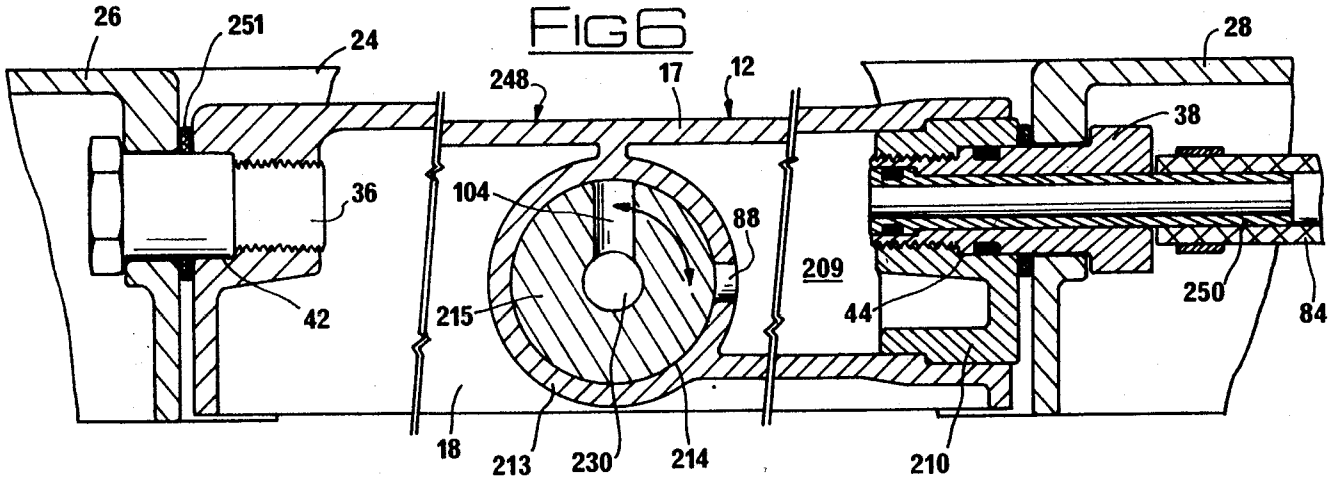
FIG. 6 is a cross-sectional view on part of the line 6—6 in FIG. 3.

The hinge-pivot is shown in cross section in FIG. 6. Pivot-pins 36,38 are screwed into respective sockets 42,44 in the seat 12. The seat 12 comprises mainly a one-piece plastic moulding 248, but the seat includes also an insert 210. The moulding 248 is formed with a cored cavity which is plugged by means of the insert 210 to form a chamber 209.

A tube 250 pases through the pivot-pin 38. The hose 84 is fastened to the tube 250. The pivot-pin 38 may therefore be rotated relative to the tube 250 and the hose 84 to enable the pivot-pin 38 to be screwed into the socket 44.

O-rings as indicated on the pivot-pin 38 ensure that water passes from the hose 84 into the chamber 209 without leaking. Washers 251 locate the seat 12 centrally between the housings 26,28.

Spray arm

The seat 12 includes an inner wall 16 and an outer wall 18. Locally in the centre of the seat, at the back, the outer wall 18 is so moulded as to comprise a boss 213. The boss 213 has a cylindrical through-hole 214 which lies on an axis that runs along the longitudinal axis of the seat. As may be seen, the axis is also perpendicular to the wall 18.

Fitted into the through-hole 214 is a spindle 215. The spray-arm 108 of the bidet is attached to the spindle 215 by means of bolts 98. The spindle 215 and the boss 213 thus comprise a journal bearing, by means of which the spray-arm 108 is mounted for rotation with respect to the seat 12.

The spindle 215 includes a flange 101. A washer 216, made of soft material, is trapped between the spray-arm 108 and the boss 213. The washer 216 provides resilience by which the flange 101 is held lightly against the other side of the boss 213, for the purpose of locating the spindle 215, and the spray-arm 108, axially. FIG. 9 shows that the flange 101 co-operates with abutments 87 to restrict the permitted movement of the spray-arm 108 to 90 degrees.

The spray-arm 108 includes a spigot 100 which engages a hole 102 in the inner wall 16; this engagement comprises a second journal bearing, to supplement that comprising the spindle 215 and the boss 213.

The spindle 215 is provided with two O-rings 217,219. The chamber 209 includes a supply conduit 88, which breaks through the wall of the hole 214 at a point between these two O-rings 217,219. The spindle 215 includes a receiving conduit in the form of a radial hole 104, which is positioned between the two O-rings. The receiving conduit 104 feeds water to a hole 230, which connects with a hole 235 and a spray-arm conduit 106 that is formed internally in the spray-arm 108. The hole 104 only lines up with the supply conduit 88 when the spray-arm 108 is in the in-use position.

The spray-arm 108 could be made as one long curved tube, but preferably the spray-arm comprises two spray-arm pieces 96,231. Respective channels are provided in each spray-arm piece and the channels are so arranged that they form the spray-arm conduit 106 when the spray-arm pieces are brought together.

The spray-arm pieces are complementary plastic mouldings, which are ultrasonically welded together. A ridge 234 is provided on one of the spray-arm pieces, 96, which engages a channel in the other 231. This engagement ensures that the spray-arm pieces are properly located together and are watertight.

Spray-apparatus

The spray-arm 108 is provided with a spray-apparatus at the end of the spray-arm, and another spray-apparatus at an intermediate point on the spray-arm. Both are constructed in the same manner.

The two spray-arm pieces 96,231 are formed complementarily to provide a spherical cavity 236, and to receive a screw-threaded insert 170 of stainless steel or other suitable metal, which is coaxial to the cavity 236.

Figure 10:
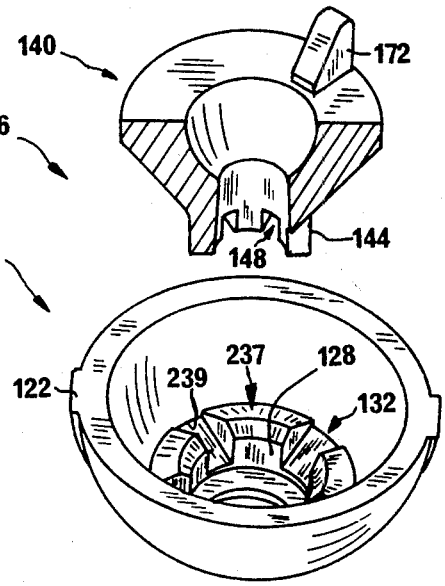
FIG. 10 is an exploded view of a jet-member.

A jet-member 116 is held in the cavity 236 by means of a screw 164. The jet-member is in two component-parts 118,140, which fit together in the manner shown in FIGS. 10 and 11.

The inner component-part 140 includes a cylindrical shaft-portion 144, which is formed with six window-slots 148. The outer component-part 118 includes a complementary hole, the cylindrical wall 128 of which is formed with complementary slots 132. The window-slots 148 extend radially inwards from the cylindrical wall 144 and the slots 132 extend radially outwards from the wall 128.

The arrangement is such that the inner component-part 140 may be rotated with respect to the outer component-part 118. The window-slots 148 may be aligned with the slots 132 in a first orientation of the component-parts, in which case water may flow freely through the slots. In another orientation of the component-parts, the window-slots 148 are aligned with, and overlap, the lands 237 between the slots 132, in which case a small amount of water is allowed to flow for self-cleaning of the slots. In a third, intermediate orientation, the window-slots 148 are only partially overlapped by the slots 132, in which case the flow of water is controllably restricted. It will be appreciated that if there are six equal slots, in each component-part, the component-parts must be turned relatively through 30 degrees for the slots to go from fully open to fully closed.

The window-slots 148 and the slots 132 together comprise six variable size nozzle-holes. Water squirts from the six nozzle-holes in an outwards direction. The water impinges upon a deflector 239, which in fact is the back wall at the roots of the slots 132. The water then collects in the annular chamber 240 which is created between the two component-parts 140,118. Here, the separate jets coalesce back into a coherent stream, and the water emerges from the discharge outlet 152 at the mouth of the annular chamber 240 in the form of a flowing tube of water.

Figure 11:
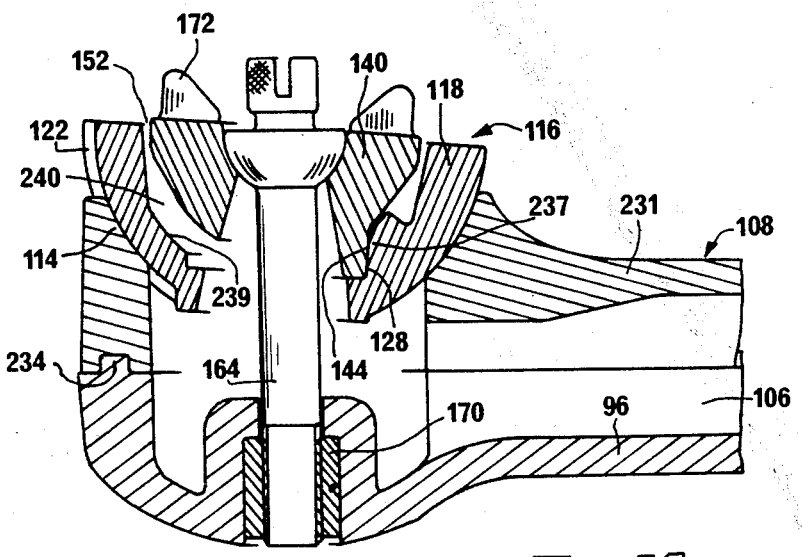
FIG. 11 is a cross-sectional view through a spray-apparatus.

In FIG. 11, the left side of the Figure shows the slots 132,148 set to create a free passage, whereby the water can flow from the conduit 106 and out through the discharge opening 152. In the right side of the Figure, the slots are out of alignment, whereby the flow of water is prevented.

The outer component-part 118 is keyed against rotation, as at 114,122 to the outer spray-arm piece 231. The inner component-part 140 is provided with ears 172. When the ears 172 are turned by hand, the slots 148 and 132 overlap progressively. This allows the person to adjust the flow-rate.

The arrangement of the key 114,122 is such that the outer component-part 118, though it cannot rotate about the axis of the screw 164, nevertheless can rock about an axis which is orthogonal to the screw axis and to the longitudinal axis of the spray-arm 108. Thus, the two-part jet-member 116 may be set so that the tubular stream of water is directed either somewhat forwards or somewhat backwards, but not to the side. Both jet-members are adjustable as to their orientation in this manner.

The seat

The channel-shaped cross-section of the seat 12 is provided by the two side-walls 16,18 and the sitting-platform 17. The sitting-platform is depressed at the front 21, to provide access for a hand of the person who is using the bidet. The sitting-platform 17 and the inner side-wall 16 are shaped all around so that any water coming into contact with them drains back into the toilet bowl.

As regards its manufacture, the seat is moulded with a mould parting-line at the level of the bottom of the side walls. With the parting-line thus located, the chamber 209, and the bearing-hole 214 have to be formed on cores that are withdrawn from the finished moulding in the directions as may be inferred from the figures. Once such cores are provided, even the break-through hole 88 between the chamber 209 and the bearing 214 can be formed on the core. The benefit of this is that virtually no production operations are needed to prepare the seat for assembly to the bidet, other than the removal of moulding flash. The insert 210 also needs virtually no work after moulding, and the operation of bonding the insert 210 into the seat 12 so as to plug the end of the chamber 209, is a very simple operation.

I claim:

1. Bidet-apparatus, having a spray-apparatus, where the spray-apparatus is so disposed as to provide a stream of water directed upwards towards the perineum of a person using the bidet apparatus;

where the spray-apparatus includes a discharge outlet having a substantially continuous annular shape, the outlet being substantially non-adjustable as to its size;

where the spray-apparatus includes, upstream from the annular discharge outlet, a jet-member comprising several small nozzle-holes;

where the jet-member is adjustable to provide a range of volume flow rates from the annular discharge outlet, in that the nozzle-holes are adjustable as to size;

where the spray-apparatus includes a deflector, and where the nozzle-holes are so disposed in the spray-apparatus that water emerging from the nozzle-holes cannot pass directly through the annular discharge outlet without first impinging against the deflector;

where the annular discharge opening is so dimensioned and arranged that the stream of water that emerges from the annular discharge opening remains as a coherent, coalesced, uninterrupted tube of water, with substantially no side-spray, over a substantial proportion of the said range of volume flow rates.

2. Apparatus of claim 1, where the nozzle holes are arranged so that the jets of water are directed outwards, from an axis, and where respective deflectors lie in the path of the jets.

3. Apparatus of claim 2, where the deflectors (239) open into an annular chamber (240) which in turn opens into the discharge outlet (152) which comprises an open axial end of the annular chamber (240).

4. Apparatus of claim 3, where both the annular chamber (240) and the discharge outlet (152) have no interruptions around their respective circumferences.

5. Apparatus of claim 1, where the jet-member (116) comprises two component parts (118,140);

where a nozzle hole comprises two window-slots (132,148) provided respectively one in each of the two component parts;

and where the component-parts are relatively movable in such a manner that the two window-slots overlap each other by an amount that varies as the component-parts move.

6. Apparatus of claim 5, where the component-parts include cylinders (128,144) arranged one inside the other;

where the window-slots are formed radially through the cylinders;

and where the said movement is a relative rotational movement between the cylinders.

7. A toilet-bowl bidet apparatus having a spray-arm (108) mounted thereon, on which is at least one spray-apparatus; wherein said spray-apparatus is so disposed as to provide a stream of water directed upwards towards the perineum of a person using the bidet apparatus;

where the spray-apparatus includes a discharge outlet having a substantially continuous annular shape, the outlet being substantially non-adjustable as to its size;

where the spray-apparatus includes, upstream from the annular discharge outlet, a jet-member comprising several small nozzle-holes;

where the jet-member is adjustable to provide a range of volume flow rates from the annular discharge outlet, in that the nozzle-holes are adjustable as to size;

where the spray-apparatus includes a deflector, and where the nozzle-holes are so disposed in the spray-apparatus that water emerging from the nozzle-holes cannot pass directly through the annular discharge outlet without first impinging against the deflector;

where the annular discharge opening is so dimensioned and arranged that the stream of water that emerges from the annular discharge opening remains as a coherent, coalesced, uninterrupted tube of water, with substantially no side-spray, over a substantial proportion of the said range of volume flow rates.

8. Apparatus of claim 7 where the spray-arm (108) is fitted with two such spray-apparatus, arranged one behind the other on the arm.

9. Apparatus of claim 8 where at least one spray-apparatus is adjustable as to its orientation but only in the front-to-rear sense, so that the direction of the water emerging from the discharge outlet may be varied from a forwards to rearwards direction, but not to a sideways direction.

10. Apparatus of claim 8, where a spray apparatus is adjustable as to the size of its nozzle holes independently of the other spray apparatus.

11. Apparatus of claim 10, where the supply of water to the arm is fed from a hot water supply and a cold water supply;

where the apparatus includes three manually operated flow volume control valves;

and where the water flow from the supplies passes through respective hot (70) and cold (71) valves before the hot water flow and the cold water flow are mixed, and, after mixing, the combined flow passes through the third valve (76), before passing to the spray-arm (108).

12. Apparatus of claim 11, where the maximum cross-sectional area through which the cold flow passes is less than that through which the hot flow passes, to such an extent as to compensate for the cold water being at a higher pressure than the hot water.

13. Apparatus of claim 7, including a seat (12) which has a splash guard (16) so arranged that water substantially cannot enter between the seat (12) and the rim (201) of the toilet bowl.

14. Spray-apparatus suitable for use in a bidet, where the spray-apparatus includes a jet member (116) with several small nozzle-holes through which water emerges in respective jets;

characterized in that the apparatus includes also:

a deflector (239) placed near the nozzle-holes, and arranged so that the jets of water impinge upon the deflector; and a flow-directing means (240) for receiving the water from the deflector and conveying it in a coherent stream from a discharge outlet (152) of the spray-apparatus;

the arrangement being such that the nozzle holes are, in substance, not in line with the discharge outlet, to the extent that substantially none of the jets of water can pass directly through the discharge outlet without first impringing on the deflector;

where the nozzle-holes are of adjustable size;

where the jet-member (116) comprises two component parts (118,140);

where a nozzle hole comprises two window-slots (132,148) provided respectively one in each of the two component parts;

where the component-parts are relatively movable in such a manner that the two window-slots overlap each other by an amount that varies as the component-parts move;

where the component-parts include cylinders (128,144) arranged one inside the other;

where the window-slots are formed radially through the cylinders;

and where the said movement is a relative rotational movement between the cylinders.

* * * * *